US006390411B1

(12) United States Patent
Chal et al.

(10) Patent No.: US 6,390,411 B1
(45) Date of Patent: May 21, 2002

(54) CORES FORMED BY AT LEAST THREE SEGMENTS HAVING OBIFORMAL CURVED SURFACES

(75) Inventors: Jan Chal, Bratislava (SK); Hans Hazes, Amsterdam (NL); Hansjürgen Linde, Coburg (DE); Bernd Lühmann, Norderstedt (DE); Uwe Neumann, Coburg (DE); Ralf Schliephacke, Itzehoe (DE)

(73) Assignee: Beiersdorf AG, Hamburg (DE)

( * ) Notice: Subject to any disclaimer, the term of this patent is extended or adjusted under 35 U.S.C. 154(b) by 0 days.

(21) Appl. No.: 09/380,384

(22) PCT Filed: Mar. 4, 1998

(86) PCT No.: PCT/EP97/01209

§ 371 Date: Sep. 27, 1999

§ 102(e) Date: Sep. 27, 1999

(87) PCT Pub. No.: WO98/40301

PCT Pub. Date: Sep. 17, 1998

(30) Foreign Application Priority Data

Mar. 13, 1997 (DE) ..... 197 10 331

(51) Int. Cl.[7] ..... B65H 75/08; B65H 18/28
(52) U.S. Cl. ..... 242/613.2; 242/537; 242/160.4
(58) Field of Search ..... 242/613.2, 537, 242/160.4

(56) References Cited

U.S. PATENT DOCUMENTS 866,613 A * 9/1907 Arnold ..... 242/613.2 X
1,577,326 A * 3/1926 Leon ..... 242/613.2 X
4,909,388 A * 3/1990 Watanabe ..... 206/410
5,255,865 A * 10/1993 Buell et al. ..... 242/613
5,269,421 A * 12/1993 Taylor ..... 206/411
6,077,577 A * 6/2000 Spatorico et al. ..... 428/34.1

FOREIGN PATENT DOCUMENTS

EP 0430548 A1 11/1990 ..... B65H/75/10
EP 0670277 A2 3/1995 ..... B65H/18/10
JP 63-66076 * 3/1988 ..... 242/613.2 X

OTHER PUBLICATIONS

Patent Abstracts of Japan, Abstract of Publication No. 04059558 (Feb. 26, 1992).

* cited by examiner

*Primary Examiner*—Donald P. Walsh
*Assistant Examiner*—Minh-Chau Pham
(74) *Attorney, Agent, or Firm*—Norris McLaughlin & Marcus

(57) ABSTRACT

Core for winding self-adhesively coated materials in web form, wherein the outer contour of the core is formed by at least one substantially round, self-contained segment, the ends of which run together in an edge, with a) the round segment being shaped convexly with respect to the axis of the core, b) the normals to the surface of the round segment being aligned substantially orthogonally with respect to the axis of the core, c) the edge being aligned substantially parallel with respect to the axis of the core and the core having a recess on the inside, so that the roll together with the core can be fitted on commercially available adhesive tape dispensers which have cylindrical core holders.

18 Claims, 2 Drawing Sheets

CORES FORMED BY AT LEAST THREE SEGMENTS HAVING OBIFORMAL CURVED SURFACES

The invention relates to a further development of the known cores of cylindrical shape, which are used for carrying a roll of self-adhesively coated materials in web form.

BACKGROUND OF THE INVENTION

Such winding cores are generally of cylindrical, in other words circularly round shape. Typical embodiments comprise single or double walled plastic cores or else such cores consisting of paperboard. The internal diameters of adhesive-tape winding cores are usually adapted to the processing equipment of the rolls of self-adhesive tape containing them. Typical internal diameters are, for example, 1 inch, 1.5 inches, 50 mm or 3 inches. The thickness, shape and internal diameter of the winding cores depend, inter alia, on the requirements to be met in producing and processing the individual rolls. The widths of ready-made rolls of self-adhesive tape are typically in the range of just a few mm up to about 200 mm. The width of the winding cores respectively used usually corresponds to the width of the adhesive tape wound up onto them.

Non-cylindrical shapes of winding core are used for special self-adhesive tapes. For example, U.S. Pat. No. 5,269,421 ("Package for PSA tape has thin two-ply core with length of PS tape wound around it in layers") describes a flat, planar two-ply rectangular core, around which an adhesive tape is wound. One advantage of the adhesive tape wound onto the rectangular core is its space-saving (flat) made-up form.

Because of their round shape, cylindrical winding cores offer numerous advantages over non-round geometries for the winding and splitting process in the processing of the master rolls of adhesive tape (jumbos) to be separated into small rolls. In particular, during fabrication of the rolls it is easy to set constant winding forces over the entire circumference of the rolls. Corresponding advantages likewise apply in the processing of the small rolls.

An important quality criterion for rolls of self-adhesive tape is their freedom from telescoping and, in many cases, the absence of air inclusions (fish eyes) between neighbouring layers of adhesive tape. Telescoped rolls of self-adhesive tape can often no longer be processed satisfactorily, both because of the changes which have occurred in the shape and dimensions of the roll and because of the frequently encountered deformation of the adhesive film strip itself. Fish eyes are often undesired in the case of rolls of transparent adhesive tape for aesthetic reasons, since they reduce the transparency of the rolls. However, they also often cause increased unrolling noise when cutting the adhesive tape to length and uneven adhesive forces of the order of magnitude of the fish eyes occurring, hence they may also bring about technical disadvantages. Furthermore, it is often the case, for example, that, in spite of using adhesive tapes which are highly transparent in individual layers, information applied to the outside of the winding core, for example by printing onto it or inserting a printed paper, is not visible, or only to a restricted extent, because of the formation of fish eyes. Such hazy rolls additionally often give the consumers the impression of inferior quality. The production of rolls of adhesive tape which are free from telescoping and at the same time have no fish eyes is often impossible or in many cases can be accomplished only with difficulty without correspondingly complex technical precautions, such as are described, for example, in EP 0 670 277 A ("Method of making pressure sensitive adhesive tape rolls with a transparent to the core appearance"). Thus, winding without fish eyes can only be achieved by means of a correspondingly high winding tension or a comparatively high contact pressure when producing small rolls. However, all the aforementioned measures increase the risk of the rolls of adhesive tape subsequently telescoping. This applies in particular to rolls of adhesive tape made up in great lengths and at the same time having a small roll width.

Known methods of reducing the tendency to telescope while at the same time increasing the winding tension (and the resultant reduction in the frequency of fish eyes) are to use winding cores of a barrel-shaped form, to use winding cores which have a slight elevation in the middle and to use slit cores, as are described, for example, in EP 0 430 548 A ("Collapsible core adhesive rolls").

Among the main disadvantages of using the aforementioned cores are that

- winding cores of a barrel-shaped form and those which have a slight elevation in the middle cannot be obtained in a simple way by separating ready-made product,
- slit cores have a lower mechanical stability on account of the slits being introduced,
- if winding cores of a barrel-shaped form or those with an elevation in the middle are used, adhesive tape from the winding close to the core is markedly deformed by the non-cylindrical core surface, which can not only cause an unsightly appearance of the unwound adhesive tape but can also cause a reduction in the technical suitability of the corresponding material.

A further possibility of reducing the tendency to telescope while at the same time increasing the winding tension is to use cores which have a smaller width than the adhesive tape wound up onto them. The disadvantage of this method is that, depending on the difference in width between the winding core and the adhesive tape, the wound-up adhesive tape may roll in, which may lead to similar disadvantages as described above.

The object of the invention was to provide a core which does not have the said disadvantages of the prior art and which is consequently able in particular to be wound largely without any fish eyes while at the same time reducing the tendency to telescope.

SUMMARY OF THE INVENTION

Accordingly, the outer contour of the core for winding self-adhesively coated materials in web form is formed by at least one substantially round, self-contained segment, the ends of which run together in an edge, with a) the round segment being shaped convexly with respect to the axis of the core, b) the normals to the surface of the round segment being aligned substantially orthogonally with respect to the axis of the core, c) the edge being aligned substantially parallel with respect to the axis of the core, and the core having a recess on the inside, so that the roll together with the core can be fitted on commercially available adhesive tape dispensers, which have a, in particular cylindrical, core holder.

In a second embodiment, the outer contour of the core for winding self-adhesively coated materials in web form is formed by at least two segments substantially in the form of portions of a circle, with a) the segments being arranged convexly with respect to the axis of the core, b) the normals to the surfaces of the segments being aligned orthogonally with respect to the axis of the core, c) the edges at which the segments meet being aligned parallel with respect to the axis of the core and the core having a recess on the inside, so that the roll together with the core can be fitted on commercially available adhesive tape dispensers, which have a, in particular cylindrical, core holder.

DETAILED DESCRIPTION

The outer contour of the core is advantageously formed by two to seven segments of the same shape in the form of portions of a circle, which are arranged symmetrically around the axis of the core, with a) the segments being arranged convexly with respect to the axis of the core, b) the normals to the surfaces of the segments being aligned orthogonally with respect to the axis of the core, c) the edges at which the segments meet being aligned parallel with respect to the axis of the core.

If the core according to the invention is viewed from the side, the space bounded by the outer contour defines a regular lune to pentagon of arcs. Typical embodiments comprise curve shapes of equal thickness, such as, for example, those based on regular or even non-regular Reuleaux polygons.

In a particularly preferred embodiment of the core according to the invention, the outer contour is formed by three segments of the same shape in the form of portions of a circle, which are arranged symmetrically around the axis of the core, with again a) the segments being arranged convexly with respect to the axis of the core, b) the normals to the surfaces of the segments being aligned orthogonally with respect to the axis of the core, c) the edges at which the segments meet being aligned parallel with respect to the axis of the core.

If the core according to the invention is viewed from the side, the space bounded by the outer contour defines a regular triangle of arcs.

Figure 1:
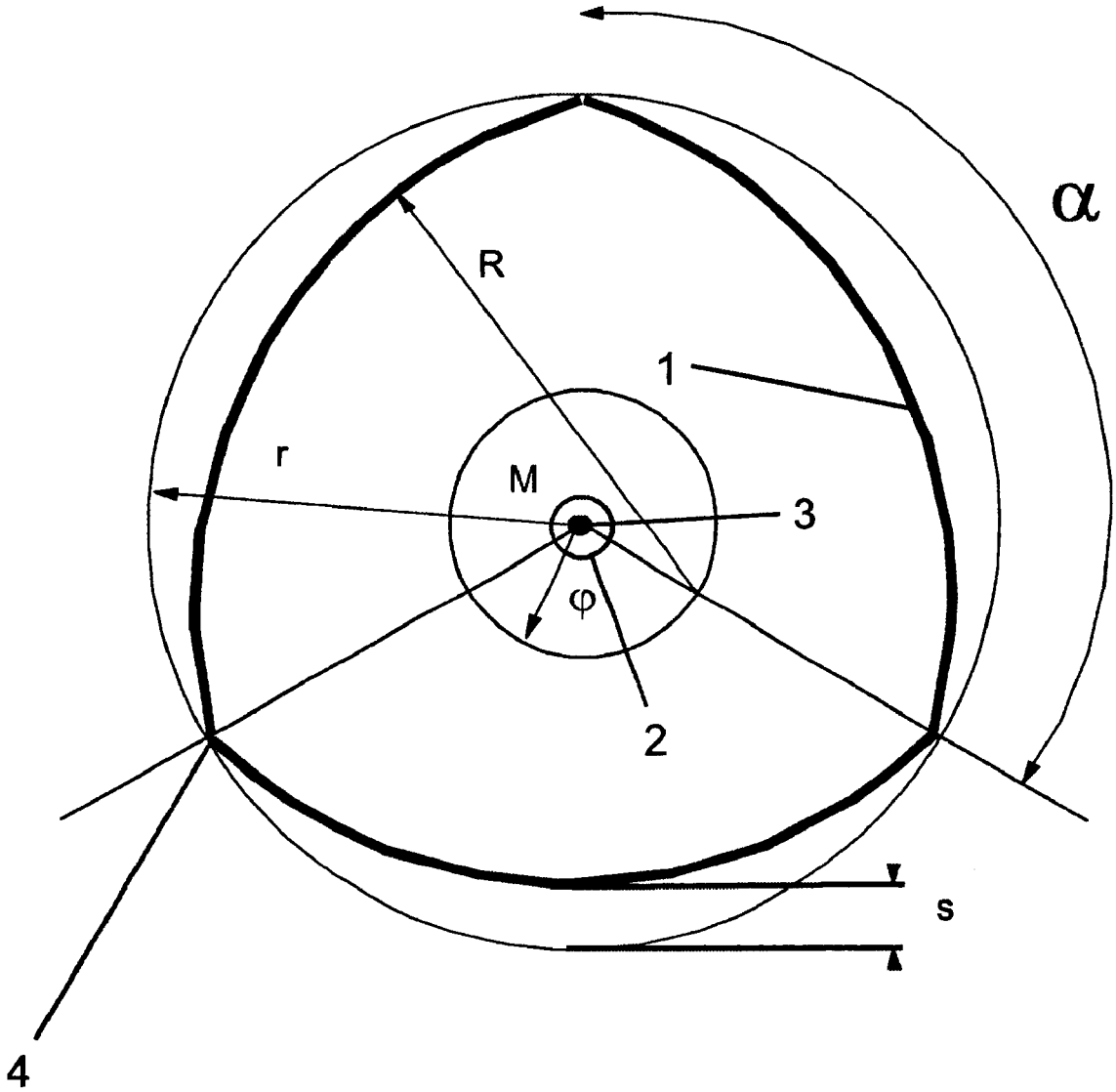
FIG. 1 shows the core of the present invention, having three segments (1), recess (2), axis 3 and edges 4.

The edges at which the segments meet are preferably of a pointed shape. In a further advantageous embodiment, the edges have a radius of curvature of less than 3 mm, preferably less than 1 mm, particularly preferably less than 0.6 mm.

The normals to the surfaces preferably form an angle of between 80° and 90° with the axis of the core.

The segments preferably have an angle of their portion of a circle of greater than or equal to 30°.

Furthermore, it is within the idea of the invention if the segments have a slightly spherical shape, it being further preferred for the segments to have the highest elevation in the middle.

Suitable as materials for producing cores according to the invention are the conventional materials, also used for producing cylindrical cores, such as, for example, numerous plastics, which can be used in pigmented or coloured form or in transparent appearance. Plastics processed by injection moulding, for example polystyrene, are preferably used. However, depending on the design of the dispenser used, cores of stone, ceramic, metal or paperboard can also be used.

Suitable adhesive films include those which comprise a substrate of plastic film which is provided on one or both sides with a pressure-sensitive adhesive composition. Suitable plastic films comprise those based on polyolefins, in particular of polyethylene and polypropylene, polyesters, polyamides, polystyrene, to name but a few. Films may be used in unstretched or stretched (monoaxially or biaxially) form. Film substrate thicknesses are preferably between 12 $\mu$m and 100 $\mu$m, particularly preferably between 20 $\mu$m and 60 $\mu$m. Suitable pressure-sensitive adhesive compositions include, inter alia, those based on natural-rubber-resin mixtures, synthetic-rubber-resin mixtures, acrylate copolymers and polyolefins. The materials listed here only represent possibilities by way of example. It goes without saying that the idea of the invention also includes other materials not specifically mentioned here.

The cores according to the invention which deviate from the conventional cylindrical shape surprisingly show outstanding properties. When the cores are used, non-round 'rolls' of adhesive tape are obtained, which are better referred to in the further description as wound forms of adhesive tape. These wound forms of adhesive tape permit great freedom from fish eyes while at the same time reducing the tendency to telescope.

In addition, the cores, and wound forms of adhesive tape, according to the invention have further advantages. For instance, upright cores and wound forms of adhesive tape offer greater stability than rolls in the production and processing area. Furthermore, such wound forms of adhesive tape have an appealing design, which favourably sets them apart from the previously known rolls.

Explanations for the increase in freedom from fish eyes with at the same time a reduction in the tendency to telescope can be found in the following observations:

The forces causing telescoping of the rolls of adhesive tape are very favourably distributed.

A correspondingly positive influence of the pulsating winding tensions/contact pressures developing according to the shape of core used in the production of the wound forms of adhesive tape.

Cores according to the invention are to be described in the following text by means of a number of examples, without wishing in this way to restrict the invention unnecessarily.

EXAMPLE 1

Rolls of adhesive tape of dimensions 33 m ×19 mm (the figures specified correspond to the length times the width of the rolls of adhesive tape) were wound by a defined winding tension and at the same time by applying contact pressure using a rotating rubber roller. The aim was to obtain a transparent roll which, on the one hand does not telescope after winding on account of excessive winding tension and, on the other hand, is not affected by air inclusions in the form of small bubbles, so-called fish eyes.

The following test parameters were chosen for this:

Web speed=20 m/min

Winding tension=1.1 N/cm

Contact pressure of the pressure-applying rollers=1.0 ±0.5 N/cm

In an analogous way, a 19 mm wide hexagonal core, which when viewed from the side represents a regular hexagon, with rounded-off edges (corners), and a 19 mm wide orbiformal curved body, such as that shown in FIG. 1, comprising three uniform, symmetrically arranged segments of a circle, were processed into corresponding wound forms of adhesive tape.

The hexagonal core had an internal diameter of 26 mm. Its external diameter between parallel outer limitations was 28 mm and between opposite edges was 30 mm. The edges had a radius of curvature of 3 mm.

Orbiforms are curved bodies with a contour of constant breadth. The basic form of the orbiformal curved body in question is determined by an isosceles triangle. Orbiforms are usually used in the construction of gear mechanisms, in order to transform rectilinear movements smoothly into back and forth or up and down movements.

The geometry of the orbiformal curved body used could be described as follows:

Its basic form is an equilateral triangle with $\alpha$=120°. On rotation about the centre point M, a circle with the arc radius r and a so-called throw s are produced. The orbiformal curved body used for the winding tests had the dimensions given in the following table (see FIG. 1):

TABLE 1

| Dimensions of the orbiformal curved body used | |
|---|---|
| $\alpha$ | 120° |
| R | 26 mm |
| $\phi$ | 7 mm |

All the wound forms of adhesive tape were kept at a temperature of 40° C. for 48 hours, after which they were inspected to determine product containing fish eyes and telescoped product.

For each form of winding, 50 wound bodies of adhesive tape were evaluated. The following results were obtained:

TABLE 2

| Results of the series of tests | | |
|---|---|---|
| Form of core | Product containing fish eyes [%] | Telescoped product [%] |
| Round | 12 | 18 |
| Hexagon | 100 | 30 |
| Orbiformal curved body | 0 | 0 |

EXAMPLE 2

To verify the explanations as to why the orbiformal curved body permitted roll winding without telescoping or fish eyes, in a second series of tests a curved body comprising two segments (lune of arcs) with $\alpha$=180° was investigated as the roll core.

The following test parameters were chosen for this:

Web speed=20 m/min

Winding tension=1.1 N/cm

Contact pressure of the pressure-applying rollers=1.0 +0.5 N/cm 50 wound bodies of adhesive tape in the form of a lune of arcs was wound with contact pressure during the winding process; 50 wound bodies of adhesive tape in the form of a lune of arcs were wound without contact pressure.

The geometry of the lune of arcs used can be described as follows:

The basic form of the lune of arcs is defined by $\alpha$=180°. On rotation about the centre point M, a circle with the arc radius r and a so-called throw s are produced.

Figure 2:
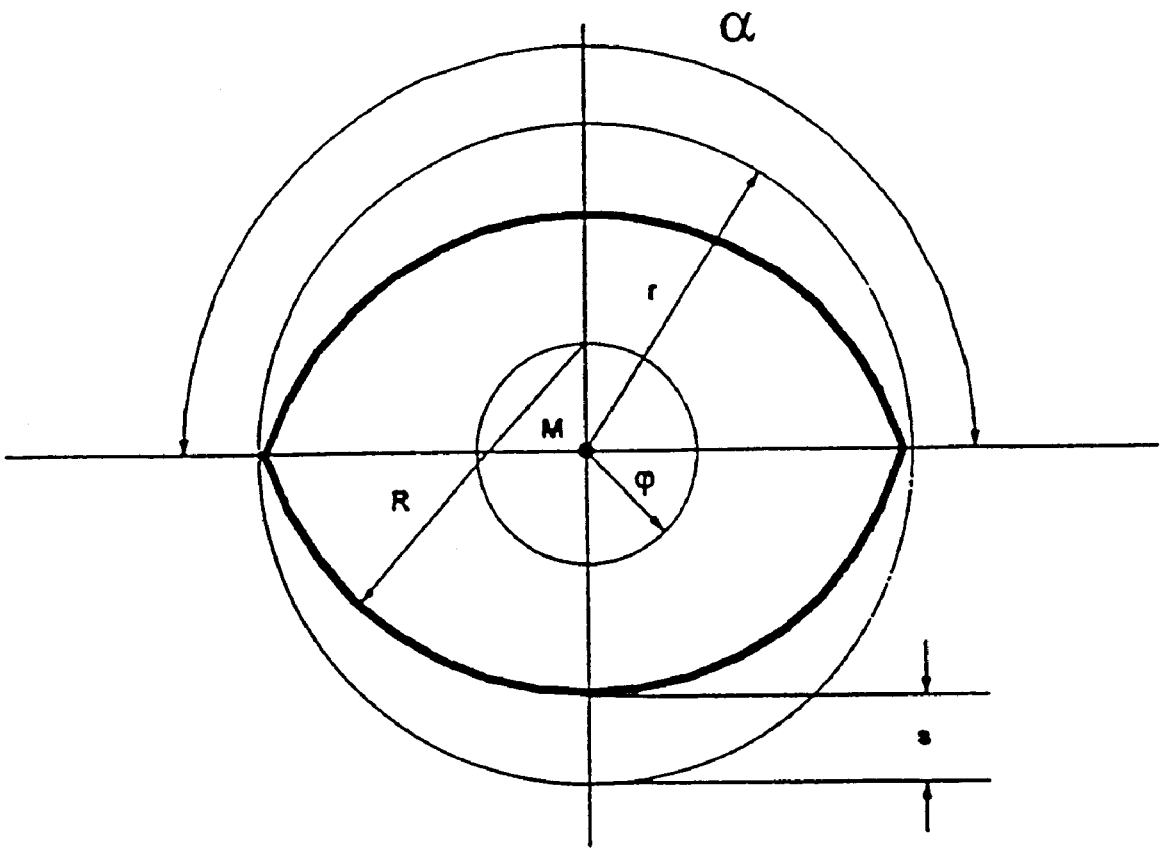
FIG. 2 shows the core of the intention having two segments. The recess of the core is not illustrated in FIG. 2.

The lune of arcs used for the winding tests had the dimensions given in the following table (see FIG. 2):

TABLE 3

| Dimensions of the lune of arcs used | |
|---|---|
| $\alpha$ | 180° |
| R | 23 mm |
| $\phi$ | 7.5 mm |

All the wound forms of adhesive tape were kept at a temperature of 40° C. for 48 hours, after which they were investigated to determine product containing fish eyes and telescoped product.

For each form of winding, 50 wound bodies of adhesive tape were evaluated. The following results were obtained:

TABLE 4

| Results of the second series of tests | | | |
|---|---|---|---|
| Form of core | Product containing fish eyes [%] | Telescoped product [%] | Contact pressure during winding |
| Round | 10 | 20 | with |
| Orbiformal curved body | 0 | 0 | with |
| Lune of arcs | 0 | 0 | with |
| Lune of arcs | 0 | 0 | without |

As both series of tests show, the wound forms of adhesive tape produced by means of the cores according to the invention had virtually no deficiencies in terms of quality.

What is claimed is:

1. A wound form of adhesive tape, wherein an adhesive tape is wound on a core having an outer contour which is formed by at least three substantially round, self-contained segment, the ends of said substantially round, self-contained segment meeting to form an edge, with a) the at least one round segment being shaped convexly with respect to the axis of the core, b) the surface of the at least one round segment having normals aligned substantially orthogonally with respect to the axis of the core, c) said edge being aligned substantially parallel with respect to the axis of the core and the core having a recess on the inside, so that the core, with the adhesive tape wound thereon, can be fitted on an adhesive tape dispenser having a cylindrical core holder.

2. The wound form of adhesive tape according to claim 1, wherein the edges at which the segments meet have a radius of curvature of less than 3 mm.

3. The wound form of adhesive tape according to claim 1, wherein the normals to the surfaces form an angle of between 80° and 90° with the axis of the core.

4. The wound form of adhesive tape according to claim 1, wherein the segments have a slightly spherical shape.

5. Core according to claim 4, wherein the segments have the highest elevation in the middle.

6. Core forwinding self-adhesively coated materials in web form, having an outer contour formed by at least three segments substantially in the form of portions of a circle, with a) the segments being arranged convexly with respect to the axis of the core, b) the surfaces of the segments having normals aligned orthogonally with respect to the axis of the core, c) adjacent segments meeting each other and forming edges where they meet, said edges being aligned parallel with respect to the axis of the core and the core having a recess on the inside, so that the core together with self-adhesively coated materials wound thereon can be fitted on cylindrical core holders.

7. Core according to claim 6, wherein the outer contour of the core is formed by two to seven segments of the same shape in the form of portions of a circle, which are arranged symmetrically around the axis of the core, with a) the segments being arranged convexly with respect to the axis of the core, b) the normals to the surfaces of the segments being aligned orthogonally with respect to the axis of the core, c) the edges at which the segments meet being aligned parallel with respect to the axis of the core.

8. Core according to claim 6, wherein the edges at which the segments meet are of a pointed shape.

9. Core according to claim 6, wherein the edges at which the segments meet have a radius of curvature of less than 3 mm.

10. Core according to claim 6, wherein the normals to the surfaces form an angle of between 80° and 90° with the axis of the core.

11. Core according to claim 6, wherein the segments have an angle of their portion of a circle of greater than or equal to 30°.

12. Core according to claim 6, wherein the segments have a slightly spherical shape.

13. Core according to claim 12, wherein the segments have the highest elevation in the middle.

14. A wound form of adhesive tape, wherein an adhesive tape is wound on a core having an outer contour formed by at least three segments substantially in the form of portions of a circle, with a) the segments being arranged convexly with respect to the axis of the core, b) the surfaces of the segments having normals aligned orthogonally with respect to the axis of the core, c) adjacent segments meeting each other at edges, said edges being aligned parallel with respect to the axis of the core and the core having a recess on the inside, so that the core together with self-adhesively coated materials wound thereon can be fitted on cylindrical core holders.

15. The wound form of adhesive tape according to claim 14, wherein the outer contour of the core is formed by three segments of the same shape in the form of portions of a circle, which are arranged symmetrically around the axis of the core, with a) the segments being arranged convexly with respect to the axis of the core b) the normals to the surfaces of the segments being aligned orthogonally with respect to the axis of the core, c) the edges at which the segments meet being aligned parallel with respect to the axis of the core.

16. The wound form of adhesive tape according to claim 14, wherein the edges at which the segments meet are of a pointed shape.

17. The wound form of adhesive tape according to claim 14, wherein said portions are defined by an angle of greater than or equal to 30°.

18. A wound form of adhesive tape, wherein an adhesive tape is wound on a core having an outer contour formed by three to seven segments of the same shape in the form of portions of a circle, which are arranged symmetrically around the axis of the core, with a) the segments being arranged convexly with respect to the axis of the core, b) the surfaces of the segments having normals aligned substantially orthogonally with respect to the axis of the core, c) adjacent segments meeting each other at edges, said edges being aligned parallel with respect to the axis of the core and the core having a recess on the inside, so that the core together with self-adhesively coated materials wound thereon can be fitted on cylindrical core holders.

* * * * *